US007922366B2

(12) United States Patent
Li

(10) Patent No.: US 7,922,366 B2
(45) Date of Patent: Apr. 12, 2011

(54) LED LIGHT SOURCE WITH LIGHT REFRACTOR AND REFLECTOR

(76) Inventor: Chia-Mao Li, Taipei (TW)

( * ) Notice: Subject to any disclaimer, the term of this patent is extended or adjusted under 35 U.S.C. 154(b) by 224 days.

(21) Appl. No.: 12/266,558

(22) Filed: Nov. 7, 2008

(65) Prior Publication Data

US 2010/0118547 A1 May 13, 2010

(51) Int. Cl.
*F21V 7/04* (2006.01)

(52) U.S. Cl. ... 362/304; 362/307; 362/310; 362/311.02; 362/311.11; 362/545; 257/98

(58) Field of Classification Search ..... 362/296.01, 362/304, 307, 310, 311.02, 311.11, 545; 257/98

See application file for complete search history.

(56) References Cited

U.S. PATENT DOCUMENTS

| | | | | |
|---|---|---|---|---|
| 6,558,032 | B2 * | 5/2003 | Kondo et al. | 362/516 |
| 6,758,582 | B1 * | 7/2004 | Hsiao et al. | 362/302 |
| 6,796,698 | B2 * | 9/2004 | Sommers et al. | 362/555 |
| 7,275,841 | B2 * | 10/2007 | Kelly | 362/345 |
| 7,300,173 | B2 * | 11/2007 | Catalano et al. | 362/208 |
| 7,396,146 | B2 * | 7/2008 | Wang | 362/294 |
| 7,753,540 | B2 * | 7/2010 | Swantner et al. | 362/30 |

* cited by examiner

*Primary Examiner* — Ismael Negron
(74) *Attorney, Agent, or Firm* — Leong C. Lei

(57) ABSTRACT

A light source including a refraction body, a metal cup, a metal reflecting lampshade, an LED lamp body. Light emitted from the LED lamp body is reflected by the metal cup to be vertically incident into the refraction body so that the light is refracted by the refraction body; the refraction body is installed at a focus of the cambered tapered surface of the metal reflecting lampshade so that the light is reflected to have a predetermined reflected shape.

2 Claims, 4 Drawing Sheets

LED LIGHT SOURCE WITH LIGHT REFRACTOR AND REFLECTOR

FIELD OF THE INVENTION

The present invention relates to light source, in particular to a flashless light source with effects of light refraction and reflection. Light emitted from the LED lamp body is reflected by a metal cup to be vertically incident into the refraction body so that the light is refracted by the refraction body; the refraction body is installed at a focus of the cambered tapered surface of the metal reflecting lampshade so that the light is reflected to have a predetermined reflected shape to remove the flashing effect due to the small light emitted area of the LED.

BACKGROUND OF THE INVENTION

Referring to FIG. 1, in the prior art quartz bulb, a light shielding unit 2 is installed in a lampshade 1. The light shielding unit 2 has a cover portion 3 for shielding an upper side of a light source. Only light from lateral side is left. Thus light is refracted from the inner surfaces of the lampshade 1 and then is dispersed on the periphery of the lampshade 1. However the design of the light shielding unit 2 will make the manufacturing process tedious and some of the light is shielded. Therefore, the strength of the light is weakened.

In another prior art, the light emitted from the lateral side of a light source is strengthened. In one prior art, a light guide is installed at an upper side of a metal cup. An inner side of the light guide is formed as a cambered surface. A lower side of the light guide is formed as an inclined surface for refracting or dispersing light from LED (light emitting diodes) so that by the design of the inner inclined surface and cambered surface of the light guide will make the light to completely reflect. Thus light is dispersed to a periphery of the light guide so that the lateral side is lighter. However this can not provide for far distance emission.

Therefore, there is an eager demand for a novel design which provides a far place emission and removes flash from the illumination.

SUMMARY OF THE INVENTION

To achieve above object, the present invention provides a flashless light source with effects of light refraction and reflection, comprising: a refraction body, a metal cup, a metal reflecting lampshade, an LED lamp body; wherein the LED lamp body has a threaded hole and is locked to a bottom of the metal reflecting lampshade; an upper end of the LED lamp body is formed with a protrusion portion; an upper edge of the metal cup extends with an annular flange; an inner side of the metal cup is extended as a tapered surface; a lower end of the metal cup is formed as an opening for receiving the protrusion portion of the LED lamp body; an inner side of the metal reflecting lampshade has a cambered tapered surface and an inner bottom of the metal reflecting lampshade is a plane; a plurality of threaded holes are formed on the bottom plane; a center of the plane has a hole; and a lower end of the refraction body is embedded into the annular flange of the metal cup; an inner side of the refraction body is formed with an annular arc surface having a larger upper side and a tapered surface connecting to a lower end of the annular arc surface and having a larger lower side; and wherein light emitted from the LED lamp body is reflected by the metal cup to be vertically incident into the refraction body so that the light is refracted by the refraction body; the refraction body is installed at a focus of the cambered tapered surface of the metal reflecting lampshade so that the light is reflected to have a predetermined reflected shape so as to remove the flashing effect due to the small light emitted area of the LED.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
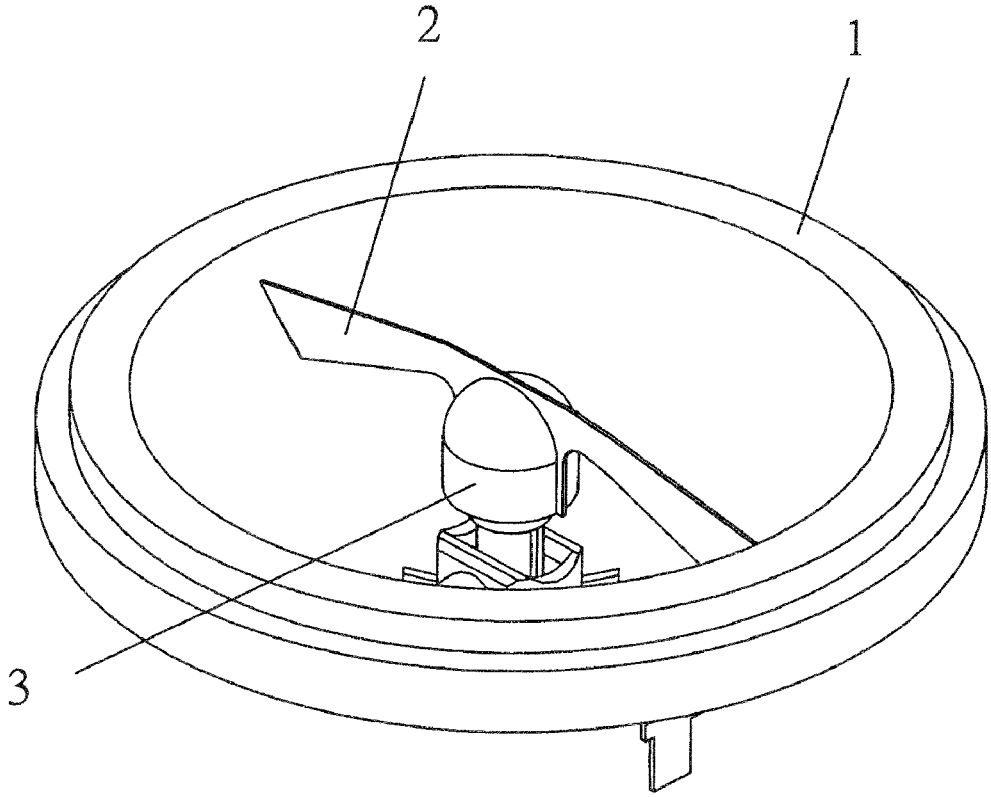
PRIOR ART Fig. 1
FIG. 1 is a perspective view of a prior art light source.
Figure 2:
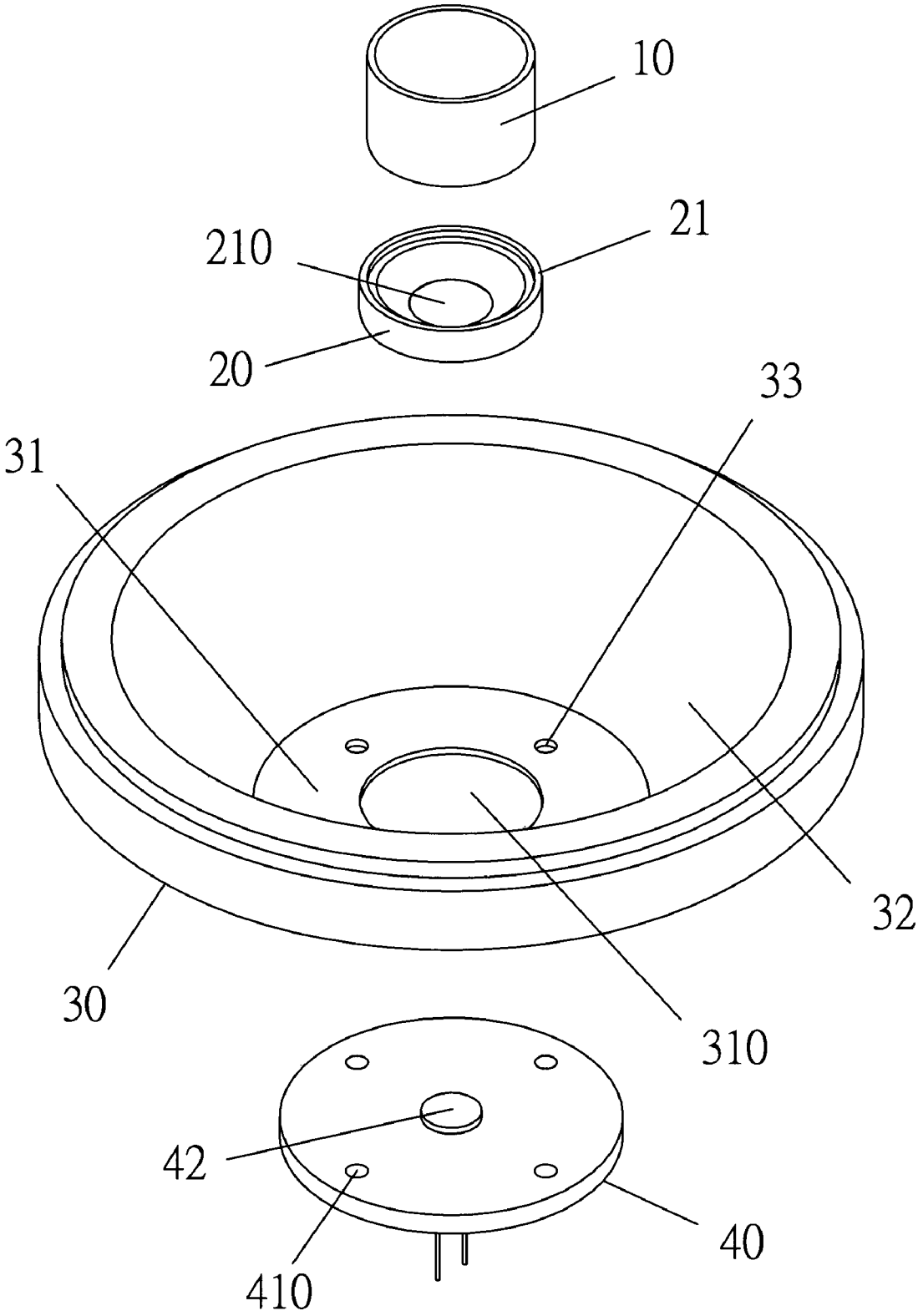
FIG. 2 is an exploded view of the present invention.
Figure 3:
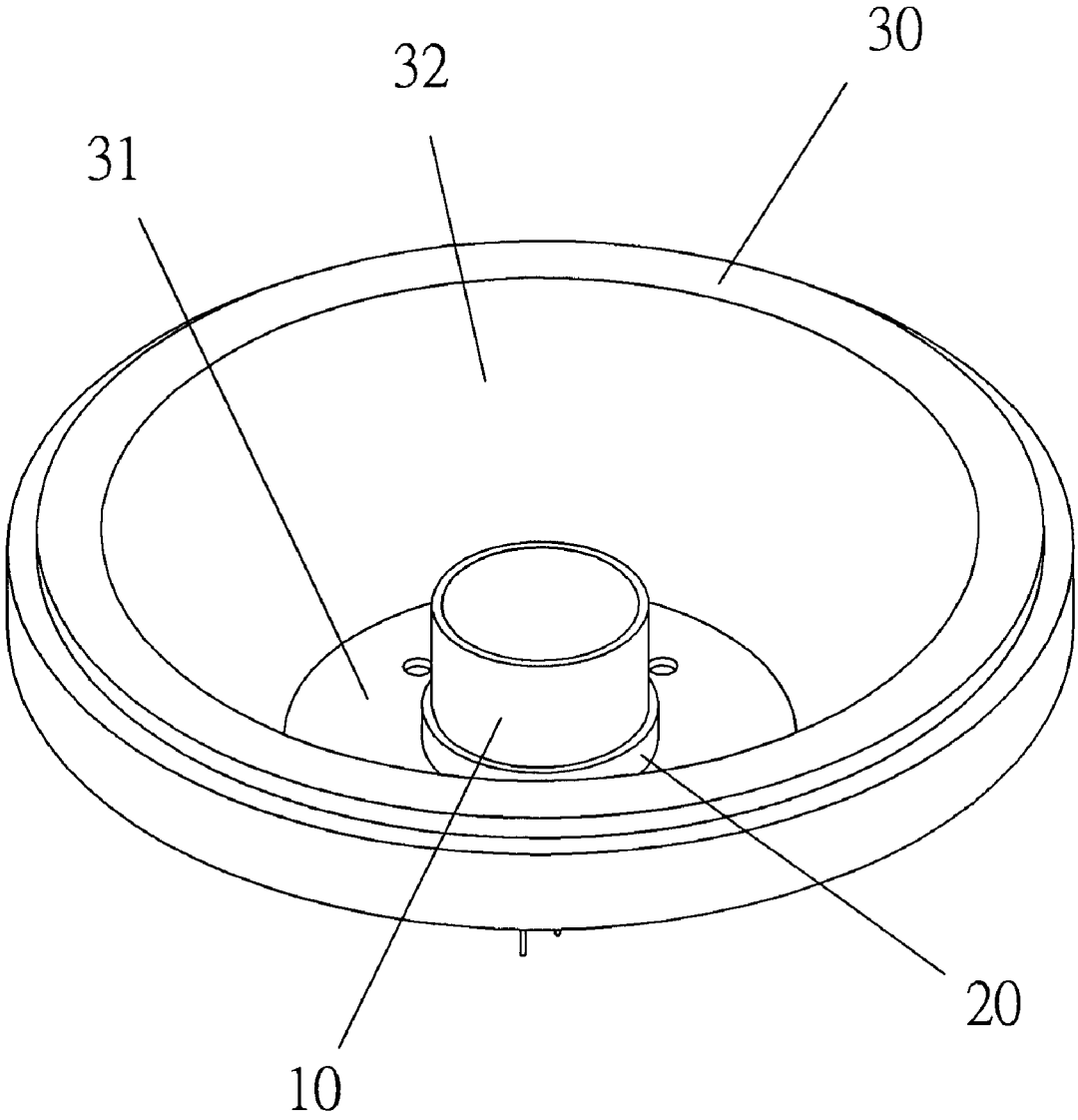
FIG. 3 is an assembled view of the present invention.
Figure 4:
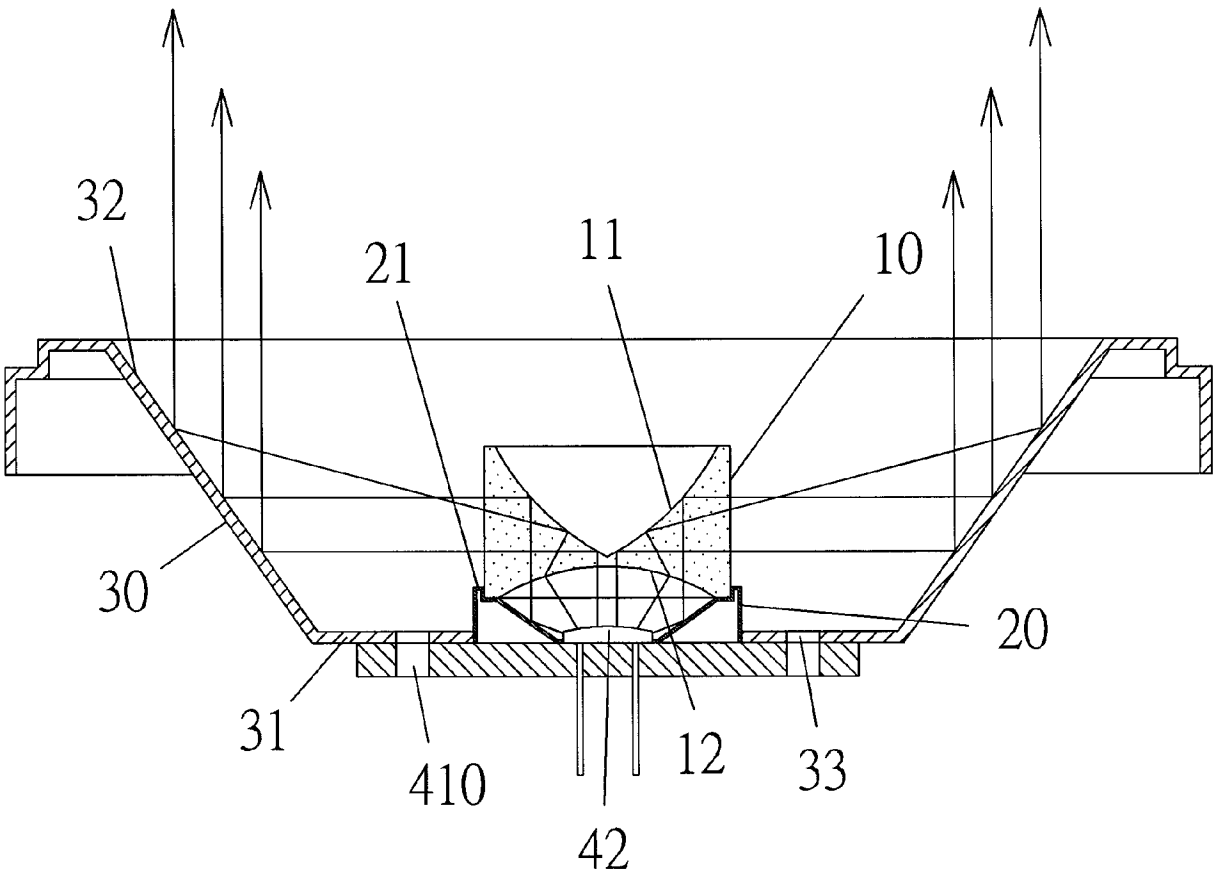
FIG. 4 is a cross sectional view of the present invention.

Referring to FIGS. 2, 3 and 4, the light source of the present invention is illustrated. The light source has a refraction body 10, a metal cup 20, a metal reflecting lampshade 30, an LED lamp body 40.

The LED lamp body 40 has a threaded hole 410 and is locked to a bottom 31 of the metal reflecting lampshade 30. An upper end of the LED lamp body 40 is formed with a protrusion portion 42.

An upper edge of the metal cup 20 extends with an annular flange 21. An inner side of the metal cup 20 is extended as a tapered surface. A lower end of the metal cup 20 is formed as an opening 210 for receiving the protrusion portion 42 of the LED lamp body 40.

An inner side of the metal reflecting lampshade 30 has a cambered tapered surface 32 and an inner bottom of the metal reflecting lampshade 30 is planar in shape. A plurality of threaded holes 33 are formed on the bottom 31. A center of the bottom 31 has a hole 310.

A lower end of the refraction body 10 is embedded into the annular flange 21 of the metal cup 20. An inner side of the refraction body 10 is formed with an annular arc surface 11 having a larger upper side and a tapered surface 12 connecting to a lower end of the annular arc surface 11 and having a larger lower side.

The light emitted from the LED lamp body 40 is reflected by the metal cup 20 to be vertically incident into the refraction body 10 so that the light is refracted by the refraction body 10. The refraction body 10 is installed at a focus of the cambered tapered surface 32 of the metal reflecting lampshade 30 so that the light is reflected to have a predetermined reflected shape to remove the flashing effect due to the small light emitted area of the LED.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A light source comprising:

a refraction body having an inner side formed with an annular arc surface having a larger upper side and a tapered surface connecting to a lower end of the annular arc surface and having a larger lower side;

a metal cup having an upper edge extending with an annular flange, an inner side of the metal cup shaped as a tapered surface, and a lower end of the metal cup including an opening;

a metal reflecting lampshade having an inner side shaped as a cambered tapered surface, a planar bottom, a plurality of threaded holes formed on the planar bottom, and a hole at the center of the planar bottom;

a LED lamp body having at least one threaded hole and an upper end formed with a protrusion portion configured to be received within the opening of the metal cup, the LED lamp body coupled to the planar bottom of the metal reflecting lampshade;

wherein a lower end of the refraction body is embedded into the annular flange of the metal cup, and light emitted from the LED lamp body is reflected by the metal cup to be vertically incident into the refraction body so that the light is refracted by the refraction body; the refraction body is installed at a focus of the cambered tapered surface of the metal reflecting lampshade so that the light is reflected to have a predetermined reflected shape.

2. The light source as claimed in claim 1, wherein an inner surface of the metal reflecting lampshade is selected from planes, irregular surfaces, rectangular surfaces, and cambered surfaces.

* * * * *